US006572329B2

(12) United States Patent
Tiemann

(10) Patent No.: US 6,572,329 B2
(45) Date of Patent: Jun. 3, 2003

(54) GAS TURBINE

(75) Inventor: Peter Tiemann, Witten (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/004,476

(22) Filed: Nov. 16, 2001

(65) Prior Publication Data

US 2002/0085908 A1 Jul. 4, 2002

(30) Foreign Application Priority Data

Nov. 16, 2000 (EP) ..... 00125032

(51) Int. Cl.[7] ..... F01D 9/06
(52) U.S. Cl. ..... 415/115; 416/96 R; 416/96 A
(58) Field of Search ..... 415/115; 416/96 A, 416/97 R, 95

(56) References Cited

U.S. PATENT DOCUMENTS

| | | | | |
|---|---|---|---|---|
| 2,956,773 A | | 10/1960 | French | |
| 3,574,481 A | | 4/1971 | Pyne | |
| 4,025,226 A | | 5/1977 | Hovan | |
| 4,063,851 A | * | 12/1977 | Weldon | 416/97 A |
| 4,135,855 A | | 1/1979 | Peill | |
| 4,252,501 A | | 2/1981 | Peill | |
| 5,320,483 A | | 6/1994 | Cunha | |
| 5,431,537 A | | 7/1995 | Sturm | |
| 5,464,322 A | | 11/1995 | Cunha | |
| 5,667,359 A | * | 9/1997 | Huber et al. | 416/96 A |
| 5,762,471 A | * | 6/1998 | Cunha | 415/115 |
| 6,036,441 A | * | 3/2000 | Manning et al. | 416/97 R |

FOREIGN PATENT DOCUMENTS

| | | |
|---|---|---|
| FR | 2221020 | 3/1973 |
| GB | 1467483 | 2/1974 |

* cited by examiner

*Primary Examiner*—Ninh H. Nguyen
(74) *Attorney, Agent, or Firm*—Harness Dickey & Pierce PLC

(57) ABSTRACT

A gas turbine blade is used for closed steam cooling. A partition, preferably designed as a metal sheet, divides a first part cavity in the axial direction. This is done in such a way that steam is capable of being guided out of the first subspace into an inlet edge cavity and from this into a second subspace with an impact-cooling effect, This has the advantage that closed steam cooling is designed to be particularly simple and cost-effective in manufacturing terms, while at the same time the inlet edge has an aerodynamically favorable shape.

38 Claims, 2 Drawing Sheets

FIG 2
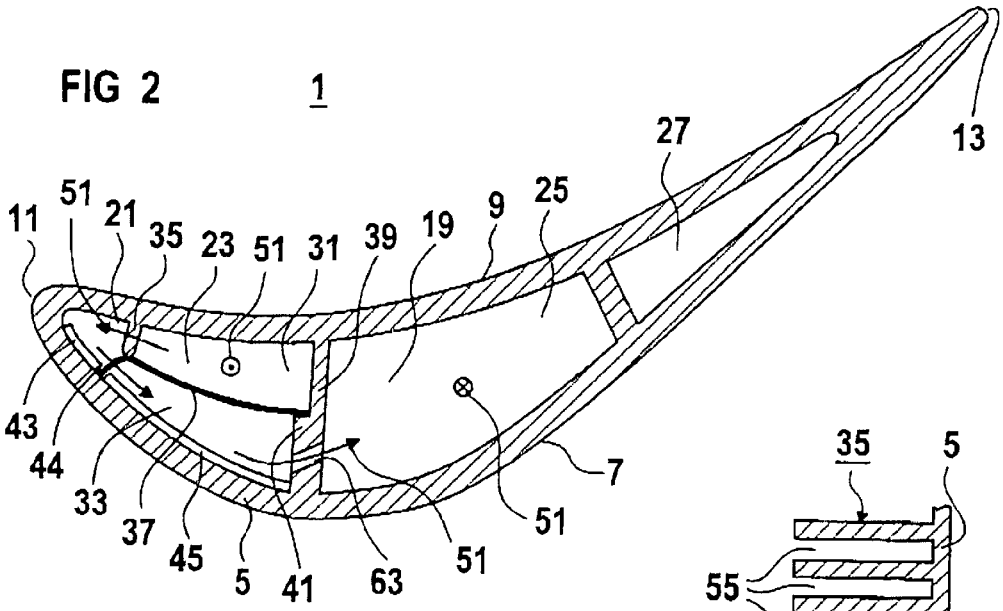
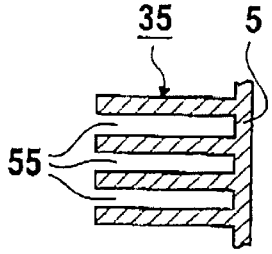
FIG 3
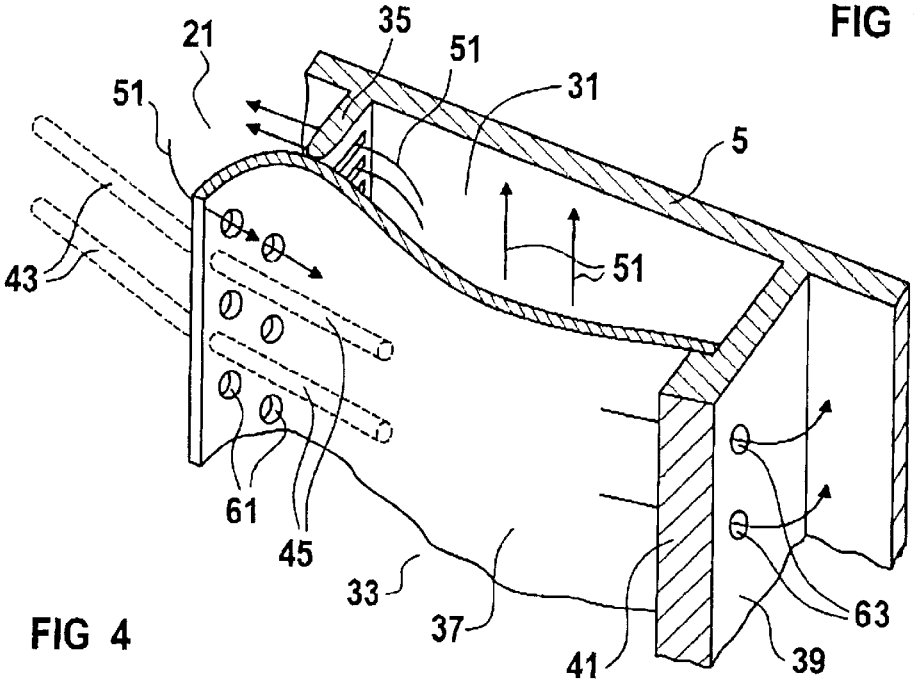
FIG 4

GAS TURBINE

This application claims priority on European application number EP 00125032.3 filed on Nov. 16, 2000 under 35 U.S.C. §119, the entire contents of which are hereby incorporated herein by reference in its entirety and for all purposes.

FIELD OF THE INVENTION

The invention generally relates to a gas turbine blade. More preferably, it relates to one with an inner cavity for the guidance of a cooling fluid.

BACKGROUND OF THE INVENTION

Such a coolable gas turbine blade is shown in U.S. Pat. No. 5,431,537. Gas turbine blades are exposed to extremely high temperatures by the hot gas flowing around them. They therefore have to be cooled. The inlet edge of a gas turbine blade is exposed to particularly high thermal loads. For this reason, the inlet edge must be cooled particularly intensively.

In the case of cooling using cooling air, the aim is to achieve as low a consumption of cooling air as possible, since the cooling-air consumption lowers the efficiency of the gas turbine. To improve the cooling, turbulators are provided on the inside of the gas turbine blade, which swirl the cooling medium and thus permit better heat transmission. In the gas turbine blade of U.S. Pat. No. 5,431,537, the turbulator configuration both achieves a beneficial cooling of the inlet edge and affords advantages regarding the castability of the turbine blade.

U.S. Pat. No. 5,320,483 shows a steam-cooled gas turbine blade. Steam cooling is more favorable in terms of the efficiency of the gas turbine. It requires a closed cooling circuit, however, since, in contrast to air, steam cannot be introduced from the blade into the hot-gas duct. For cooling the inlet edge, an impact-cooling insert is used, which guides steam into a duct according to the contour of the inlet edge, steam being conducted from this duct, via bores, against the inlet edge with an impact-cooling effect. This design is highly complicated in manufacturing terms and, furthermore, also leads to an inlet edge which is comparatively thick and therefore not optimized aerodynamically.

SUMMARY OF THE INVENTION

An object of the invention is to specify a gas turbine blade, in which it is possible for the inlet edge to be cooled in a simple way in terms of production and at the same time in an aerodynamically favorable way.

According to the invention, this object is achieved by, for example, specifying a gas turbine blade directed along a blade axis, with a profile including a suction side, a delivery side, an inlet edge and a flow-off (outlet) edge. An inner cavity is preferably included in the profile for the guidance of a cooling fluid, with the cavity including an inlet edge cavity adjacent to the inlet edge and a first part cavity adjoining the inlet edge cavity in the direction of the flow-off edge. The first part cavity is preferably divided into a first subspace and a second subspace by a partition extending in a direction from the inlet edge to the flow-off edge. Cooling fluid is capable of being introduced from the first subspace via impact-cooling orifices into the inlet edge cavity and from there into the second subspace with an impact-cooling effect on the inlet edge.

By way of this configuration, for the first time, the course is adopted of preceding the inlet edge region by a divided cavity, so that a closed cooling fluid guidance becomes possible in a structurally simple way. This construction avoids an impact-cooling insert of complex design in the region of the inlet edge and, furthermore, makes it possible to design the inlet edge in the most aerodynamically favorable way.

Preferably, the inlet edge cavity is separated from the first part cavity by a half-rib connected to the profile. Such a half-rib does not extend from the suction side as far as the delivery side, as is otherwise customary in gas turbine blades, but, instead, terminates in the cavity. For example, where a cast gas turbine blade is concerned, such a half-rib may be cocast. Cooling fluid is then guided from the first subspace via the half-rib into the inlet edge cavity, impact-cooling orifices being provided for this purpose in the half-rib. These impact-cooling orifices are also preferably designed as slots. Such a slotted half-rib can be produced simply in manufacturing terms and at the same time affords optimum impact-cooling conditions.

Preferentially, the first part cavity includes, adjoining it in the direction of the flow-off edge, a second part cavity which is separated from the first part cavity by a rib extending from the suction side to the delivery side. The cooling fluid is capable of being introduced through ducts in the rib from the second subspace into the second part cavity. Also preferably, in this case, the cooling fluid is capable of being guided in the first subspace parallel to the blade axis, in the second subspace transversely to the blade axis and in the second part cavity parallel to the blade axis. This results in the configuration where the cooling fluid in the two subspaces of the first part cavity has two flow directions directed perpendicularly to one another.

The partition is preferably a metal sheet. This affords a further simplification in manufacturing terms, precisely where cast gas turbine blades are concerned, since a partition does not have to be cocast. The partition is simply inserted into the ready-cast blade. Preferentially, in this case, the partition is clamped in clearances between cast-on turbulators and/or is added to an offset which, in particular, is cast on a rib. The partition also preferably separates the second subspace from the inlet edge cavity, the partition having orifices for introducing the cooling fluid from the inlet edge cavity into the second subspace. This design is particularly preferred in conjunction with the half-rib separating the inlet edge cavity from the first subspace. Thus, by using the half-rib on the one hand, and the partition inserted as a metal sheet on the other hand, the inlet edge cavity is separated from the first part cavity. In this case, the metal sheet is preferably supported on the first half-rib.

The gas turbine blade is preferably designed as a guide blade.

The cooling fluid is preferentially steam.

Steam cooling affords the advantage of a saving of cooling air and thus leads to an improvement in efficiency and in increase in power for the gas turbine. A steam supply can be used effectively precisely where guide blades are concerned, since the guide blades are connected to the casing, via which the cooling steam can be supplied.

BRIEF DESCRIPTION OF THE DRAWINGS

The invention is explained in more detail by way of example, with reference to the drawing, in which:

FIG. 2 shows a cross section through a gas turbine guide blade,

FIG. 3 shows a cross section through a slotted half-rib, and

FIG. 4 shows a detail of a gas turbine guide blade.

Identical reference symbols have the same significance in the various figures.

DETAILED DESCRIPTION OF THE PREFERRED EMBODIMENTS

Figure 1:
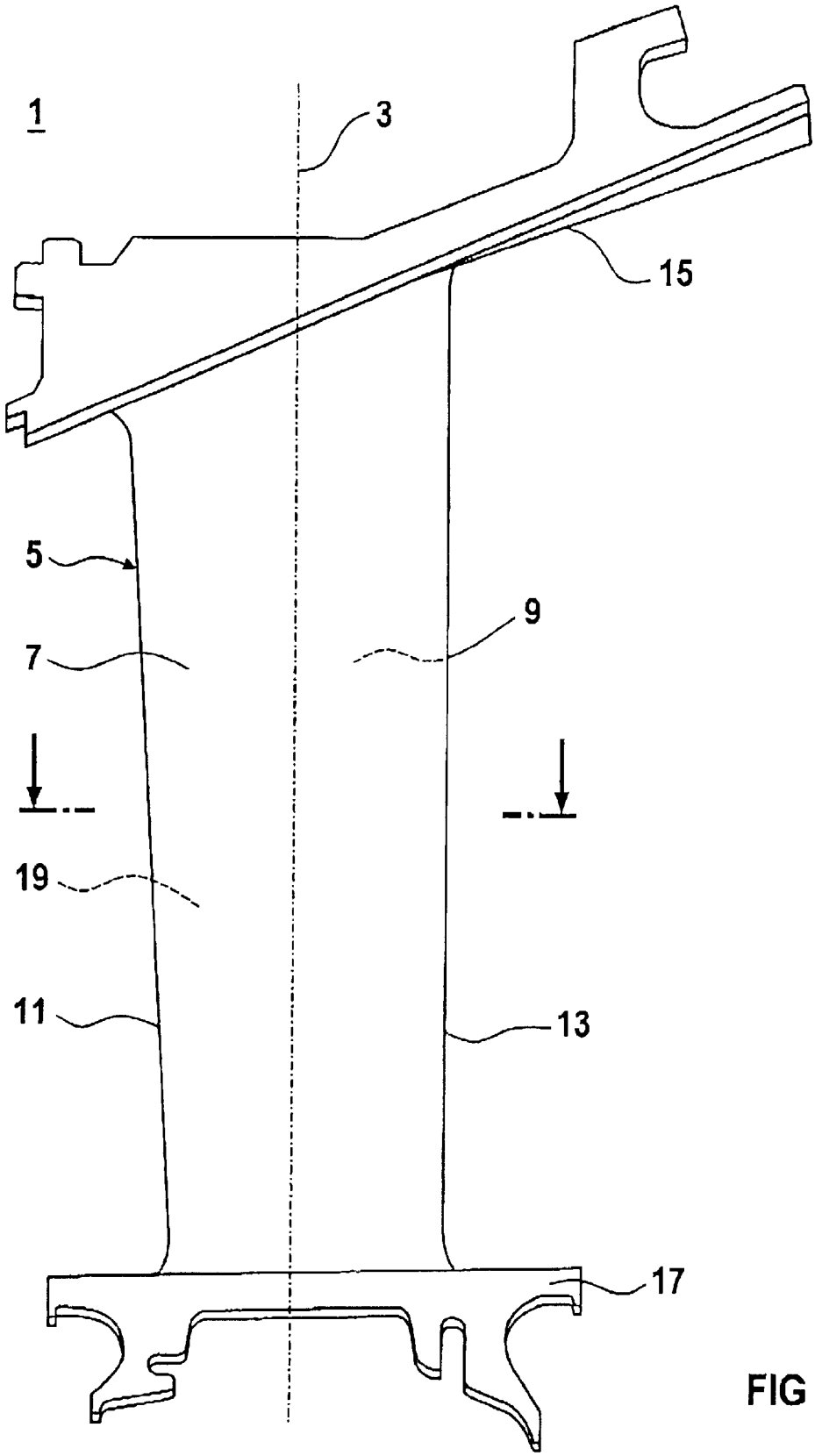
FIG. 1 shows a gas turbine guide blade.

FIG. 1 shows a side view of a gas turbine blade 1.

The gas turbine blade 1 is designed as a guide blade. It is directed along a blade axis 3. The gas turbine blade 1 includes a profile 5. The profile 5 includes a suction side 7 and a delivery side 9. Furthermore, the profile 5 includes an inlet edge 11 and a flow-off (outlet) edge 13. The profile 5 is arranged between a casing-side platform 15 and a rotor-side platform 17. The profile 5 includes an inner cavity 19 for the guidance of a cooling fluid. The design of the inner cooling structure of the profile 5 is explained in more detail by way of the following figures.

FIG. 2 shows a cross section through the gas turbine blade 1 from FIG. 1. The inner cavity 19 includes an inlet edge cavity 21 located in the region of the inlet edge 11, of a first part cavity 23 adjoining the inlet edge cavity 21 in the direction of the flow-off edge 13, of a second part cavity 25 adjoining the first part cavity 23 and of a part cavity 27 adjoining the second part cavity 25. The first part cavity 23 is subdivided into a first subspace 31 and a second subspace 33. These two subspaces 31, 33 are formed by a partition 37 which runs in the first part cavity 23 and extends in the direction from the inlet edge to the flow-off edge, so that the two subspaces 31, 33 lie next to one another in the axial direction. The partition 37 at the same time delimits the second subspace 33 from the inlet edge cavity 21.

The inlet edge cavity 21 is separated from the first subspace 31 by a half-rib 35 which extends from the delivery side 9 into the inner cavity 19 approximately as far as half the distance to the opposite suction side 7. The inlet edge cavity 21 is thus separated from the first part cavity 23 by the partition 37 pressing against the half-rib 35 and by the half-rib 35. Slot-like impact-cooling orifices 55 are arranged in the half-rib 35, as shown in FIG. 3, for example. Orifices 61 are provided in the partition 37 on the side delimiting the inlet edge cavity 21. The first part cavity 23 is separated from the second part cavity 25 by a rib 39 extending from the delivery side 9 to the suction side 7. At approximately half the width of the rib 39, the latter includes a step 41 which extends along the blade axis 3.

Turbulators 45 extending transversely to the blade axis 3 are arranged in the first part cavity 23 on the inside of the profile 5. Turbulators 43 extending transversely to the blade axis 3 are arranged in the inlet edge cavity 21 on the inside of the profile 5. A clearance 44 runs, approximately parallel to the blade axis 3, between the turbulators 43 and the turbulators 45. The partition 37 is designed as a metal sheet which is held at one end in the clearance 44 and at the other end rests on the step 41 of the rib 39. Moreover, the partition 37 is tensioned against the half-rib 35. This design allows particularly simple insertion 37, in particular, into an otherwise cast gas turbine blade 1.

When the gas turbine blade 1 is being used, cooling fluid 51, preferably steam, is introduced into the first subspace 31 of the first part cavity 23. The cooling fluid 51 passes out of the first subspace 31, via the impact-cooling orifices 55 in the half-rib 35, into the inlet edge cavity 21, in such a way that the inlet edge 11 is impact-cooled from inside. The cooling fluid 51 then, via the orifices 61 in the partition 37 (see FIG. 4), enters the second subspace 33 where it flows perpendicularly to the blade axis 3. In contrast to this, the cooling fluid 51 is guided parallel to the blade axis 3 in the first subspace 31. From the second subspace 33, the cooling fluid 51, via ducts 63 in the rib 39, enters the second part cavity 25 where it is again guided parallel to the blade axis 3 and is discharged from the gas turbine guide blade.

This construction, which is particularly simple in manufacturing terms and therefore cost-effective, makes it possible to have closed cooling fluid guidance, particularly for steam cooling, along with a permanently favorable aerodynamic configuration of the inlet edge 11.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A gas turbine blade directed along a blade axis, comprising:

a profile portion, including a suction side, a delivery side, an inlet edge and an outlet edge, wherein the profile portion includes an inner cavity for the guidance of a cooling fluid, the inner cavity including an inlet edge cavity adjacent to the inlet edge and a first part cavity adjoining the inlet edge cavity in the direction of the outlet edge, the first part cavity being divided into a first subspace and a second subspace by a partition extending in a direction from the inlet edge to the outlet edge, and wherein a cooling fluid is capable of being introduced from the first subspace via impact-cooling orifices into the inlet edge cavity and into the second subspace with an impact-cooling effect on the inlet edge, wherein the first part cavity includes adjoining in the direction of the outlet edge, a second part cavity separated from the first part cavity by a rib extending from the suction side to the delivery side, the cooling fluid being capable of being introduced through ducts in the rib from the second subspace into the second part cavity.

2. The gas turbine blade as claimed in claim 1, wherein the inlet edge cavity is separated from the first part cavity by a half-rib connected to the profile portion.

3. The gas turbine blade as claimed in claim 2, wherein the impact-cooling orifices are formed by slots running transversely to the half-rib and in the half-rib.

4. The gas turbine blade as claimed in claim 1, wherein the cooling fluid is capable of being guided in the first subspace parallel to the blade axis, in the second subspace transversely to the blade axis and in the second part cavity parallel to the blade axis.

5. The gas turbine blade as claimed in claim 1, wherein the gas turbine blade is designed as a guide blade.

6. The gas turbine blade as claimed in claim 1, wherein the partition separates the second subspace from the inlet edge cavity, the partition including orifices for introducing the cooling fluid from the inlet edge cavity into the second subspace.

7. The gas turbine blade as claimed in claim 1, wherein the partition is a metal sheet.

8. The gas turbine blade as claimed in claim 1, wherein the cooling fluid is steam.

9. A gas turbine, comprising the gas turbine blade of claim 1.

10. A gas turbine blade directed along a blade axis, comprising:

a profile portion, including a suction side, a delivery side, an inlet edge and an outlet edge, wherein the profile portion includes an inner cavity for the guidance of a cooling fluid, the inner cavity including an inlet edge cavity adjacent to the inlet edge and a first part cavity adjoining the inlet edge cavity in the direction of the outlet edge, the first part cavity being divided into a first subspace and a second subspace by a partition extending in a direction from the inlet edge to the outlet edge, and wherein a cooling fluid is capable of being introduced from the first subspace via impact-cooling orifices into the inlet edge cavity and into the second subspace with an impact-cooling effect on the inlet edge wherein the partition is a metal sheet, and wherein the partition separates the second subspace from the inlet edge cavity, the partition including orifices for introducing the cooling fluid from the inlet edge cavity into the second subspace.

11. The gas turbine blade as claimed in claim 10, where the first part cavity includes adjoining in the direction of the outlet edge, a second part cavity separated from the first part cavity by a rib extending from the suction side to the delivery side.

12. The gas turbine blade as claimed in claim 11, wherein the cooling fluid is capable of being guided in the first subspace parallel to the blade axis, in the second subspace transversely to the blade axis and in the second part cavity parallel to the blade axis.

13. The gas turbine blade as claimed in claim 10, wherein the inlet edge cavity is separated from the first part cavity by a half-rib connected to the profile portion.

14. The gas turbine blade as claimed in claim 13, wherein the impact-cooling orifices are formed by slots running transversely to the half-rib and in the half-rib.

15. The gas turbine blade as claimed in claim 10, wherein the partition is a metal sheet.

16. The gas turbine blade as claimed in claim 10, wherein the gas turbine blade is designed as a guide blade.

17. The gas turbine blade as claimed in claim 10, wherein the cooling fluid is steam.

18. A gas turbine, comprising the gas turbine blade of claim 10.

19. A gas turbine blade directed along a blade axis, comprising:

a profile portion, including a suction side, a delivery side, an inlet edge and an outlet edge, wherein the profile portion includes an inner cavity for the guidance of a cooling fluid, the inner cavity including an inlet edge cavity adjacent to the inlet edge and a first part cavity adjoining the inlet edge cavity in the direction of the outlet edge, the first part cavity being divided into a first subspace and a second subspace by a partition extending in a direction from the inlet edge to the outlet edge, and wherein a cooling fluid is capable of being introduced from the first subspace via impact-cooling orifices into the inlet edge cavity and into the second subspace with an impact-cooling effect on the inlet edge, wherein the cooling fluid is steam.

20. The gas turbine blade as claimed in claim 19, wherein the inlet edge cavity is separated from the first part cavity by a half-rib connected to the profile portion.

21. The gas turbine blade as claimed in claim 20, wherein the impact-cooling orifices are formed by slots running transversely to the half-rib and in the half-rib.

22. The gas turbine blade as claimed in claim 19, wherein the partition is a metal sheet.

23. The gas turbine blade as claimed in claim 19, wherein the gas turbine blade is designed as a guide blade.

24. The gas turbine blade as claimed in claim 19, wherein the partition separates the second subspace from the inlet edge cavity, the partition including orifices for introducing the cooling fluid from the inlet edge cavity into the second subspace.

25. The gas turbine blade as claimed in 19, where the first part cavity includes adjoining in the direction of the outlet edge, a second part cavity separated from the first part cavity by a rib extending from the suction side to the delivery side.

26. The gas turbine blade as claimed in claim 25, wherein the cooling fluid is capable of being guided in the first subspace parallel to the blade axis, in the second subspace transversely to the blade axis and in the second part cavity parallel to the blade axis.

27. A gas turbine, comprising the gas turbine blade of claim 19.

28. A gas turbine blade directed along a blade axis, comprising:

a profile portion, including a suction side, a delivery side, an inlet edge and an outlet edge, wherein the profile portion includes an inner cavity for closed cooling fluid guidance of a cooling fluid, the inner cavity including an inlet edge cavity adjacent to the inlet edge and a first part cavity adjoining the inlet edge cavity in the direction of the outlet edge, the first part cavity being divided into a first subspace and a second subspace by a partition extending in a direction from the inlet edge to the outlet edge to achieve closed cooling fluid guidance, and wherein a cooling fluid is capable of being introduced from the first subspace via impact-cooling orifices into the inlet edge cavity and into the second subspace with an impact-cooling effect on the inlet edge.

29. The gas turbine blade as claimed in claim 28, wherein the inlet edge cavity is separated from the first part cavity by a half-rib connected to the profile portion.

30. The gas turbine blade as claimed in claim 29, wherein the impact-cooling orifices are formed by slots running transversely to the half-rib and in the half-rib.

31. The gas turbine blade as claimed in claim 28, wherein the first part cavity includes adjoining in the direction of the outlet edge, a second part cavity separated from the first part cavity by a rib extending from the suction side to the delivery side, the cooling fluid being capable of being introduced through ducts in the rib from the second subspace into the second part cavity.

32. The gas turbine blade as claimed in claim 31, wherein the cooling fluid is capable of being guided in the first subspace parallel to the blade axis, in the second subspace transversely to the blade axis and in the second part cavity parallel to the blade axis.

33. The gas turbine blade as claimed in claim 28, wherein the partition is a metal sheet.

34. The gas turbine blade as claimed in claim 33, wherein the partition separates the second subspace from the inlet edge cavity, the partition including orifices for introducing the cooling fluid from the inlet edge cavity into the second subspace.

35. The gas turbine blade as claimed in claim 33, wherein the gas turbine blade is designed as a guide blade.

36. The gas turbine blade as claimed in claim 28, wherein the cooling fluid is steam.

37. The gas turbine blade as claimed in claim 28, wherein the partition separates the second subspace from the inlet edge cavity, the partition including orifices for introducing the cooling fluid from the inlet edge cavity into the second subspace.

38. The gas turbine blade as claimed in claim 28, wherein the cooling fluid is steam.

* * * * *